US007722420B2

(12) United States Patent
Shimomura et al.

(10) Patent No.: US 7,722,420 B2
(45) Date of Patent: May 25, 2010

(54) MANUFACTURING METHOD OF A PLASMA DISPLAY PANEL HAVING A BASE LAYER ALONG A FIRST DIRECTION AND A PHOSPHOR LAYER ALONG A SECOND DIRECTION THAT INTERSECTS THE FIRST DIRECTION

(75) Inventors: Kiyoshi Shimomura, Chuo (JP); Shigenori Murakami, Chuo (JP); Akinao Adachi, Chuo (JP)

(73) Assignee: Panasonic Corporation, Osaka (JP)

( * ) Notice: Subject to any disclaimer, the term of this patent is extended or adjusted under 35 U.S.C. 154(b) by 158 days.

(21) Appl. No.: 11/907,765

(22) Filed: Oct. 17, 2007

(65) Prior Publication Data

US 2008/0143237 A1 Jun. 19, 2008

(30) Foreign Application Priority Data

Dec. 19, 2006 (JP) ..... 2006-341605

(51) Int. Cl.
*H01J 9/38* (2006.01)
*H01J 9/24* (2006.01)
*B05D 5/06* (2006.01)

(52) U.S. Cl. ..... 445/14; 445/24; 427/64; 427/68

(58) Field of Classification Search ..... None
See application file for complete search history.

(56) References Cited

U.S. PATENT DOCUMENTS

| | | | | |
|---|---|---|---|---|
| 7,476,334 | B2 * | 1/2009 | Aoki et al. | 252/301.4 R |
| 2005/0206316 | A1 * | 9/2005 | Lee et al. | 313/582 |
| 2008/0143236 | A1 * | 6/2008 | Murakami et al. | 313/484 |
| 2008/0180021 | A1 * | 7/2008 | Adachi et al. | 313/503 |

FOREIGN PATENT DOCUMENTS

| | | | |
|---|---|---|---|
| JP | 10334805 | A * | 12/1998 |
| JP | 2002-75216 | | 3/2002 |

* cited by examiner

*Primary Examiner*—Toan Ton
*Assistant Examiner*—Britt D Hanley
(74) *Attorney, Agent, or Firm*—Kratz, Quintos & Hanson, LLP

(57) ABSTRACT

A manufacturing method of a PDP includes: a partition forming step to form a first partition (124) and a second partition (125) substantially perpendicular to the first partition (124) on an address-electrode dielectric layer (122) of a rear substrate (120); a base layer forming step to form a base layer after the partition forming step by moving a base-forming-agent applying nozzle (200) along a second groove formed between the second partitions (125) and applying a base forming agent (201) thereto; and a phosphor layer forming step to form a phosphor layer after the base layer forming step by moving a phosphor applying nozzle along a first groove formed between the first partitions (124) and applying a phosphor paste thereto.

5 Claims, 3 Drawing Sheets

MANUFACTURING METHOD OF A PLASMA DISPLAY PANEL HAVING A BASE LAYER ALONG A FIRST DIRECTION AND A PHOSPHOR LAYER ALONG A SECOND DIRECTION THAT INTERSECTS THE FIRST DIRECTION

BACKGROUND OF THE INVENTION

1. Field of the Invention

The present invention relates to a display panel and a manufacturing method of the display panel.

2. Description of Related Art

Conventionally, a plasma display panel (PDP) has been configured by: disposing a pair of planar substrates to face each other with a discharge space interposed therebetween; partitioning the discharge space into a plurality of discharge cells by providing a curb-shaped or striped partition on an inner surface of one of substrates; and providing the partitioned portions with phosphor layers exemplarily of red, blue and green. The PDP displays images by selectively discharging inside the discharge cells for light emitting. As a method for forming the phosphor layer in the PDP, there has been know an ink-jet method, with which a phosphor material is injected to between the partitions using, for example, a nozzle (e.g. see Document: JP-A-2002-75216).

According to a manufacturing method of a plasma display panel (PDP) disclosed in Document, an address electrode is formed on a rear panel substrate, partitions are formed on the address electrode with a pitch of a predetermined value, and a phosphor layer is formed between the partitions. The phosphor layer according to the manufacturing method of the PDP is formed using an ink ejecting device that ejects phosphor ink. A plurality of nozzle bodies of the ink ejecting device, each of which includes a nozzle and a header, are fixed to a fixing table. A supply pipe for supplying the phosphor ink from a pressurizing supply unit is connected to the header while a nozzle-flow-rate controlling valve provided to the nozzle controls a flow rate of the phosphor ink ejected from the nozzle. In the manufacturing method of the PDP, the ejecting amount of the nozzle is measured before the phosphor ink is applied, and the flow rate of the nozzle is variably controlled per one scanning, thereby preventing a column variation.

However, according to the method in which the nozzle ejects the phosphor ink for forming the phosphor layer, an error in an opening dimension of the nozzle may cause a difference in the ejecting amount of the phosphor ink, which can lead to a difference in a thickness of the phosphor layer. When there is an error in the opening dimension of the nozzle, a difference as much as the fourth power of the error value of the nozzle opening is caused in the thickness of the phosphor layer.

Although such a conventional manufacturing method of a PDP as disclosed in the above Document may be used for solving such problems, the conventional manufacturing method of the above Document requires a detector for detecting the ejecting amount of the nozzle and a complex control program for controlling the flow rate of the nozzle by a controller, which leads to a complication of a configuration.

Another possible arrangement is to thin the phosphor layer so as to reduce variations of the thickness, thereby suppressing a column variation. However, since the thickness of the phosphor layer is generally specified by a panel standard for a display panel, a realization of the arrangement may be difficult.

Another possible arrangement is to provide a base layer by printing between the phosphor layer and the substrate and to form the phosphor layer on the base layer, thereby reducing the thickness dimension of the phosphor layer. However, when the base layer is printed, a variation can be caused in a thickness dispersion, which can lead to a luminance variation.

SUMMARY OF THE INVENTION

In light of the above-described problems, an object of the present invention is to provide a display panel that is easily manufacturable and realizes good images, and a manufacturing method for the display panel.

A display panel according to an aspect of the present invention includes: a pair of substrates disposed to face each other with a discharge space being interposed; a plurality of partitions that partition the discharge space, the partitions being provided to at least one of the substrates substantially along a predetermined first direction; a phosphor layer provided between the partitions that neighbor each other substantially along the first direction; and a base layer provided to the at least one of the substrates along a second direction intersecting the first direction, in which the base layer is disposed between the phosphor layer and the at least one of the substrates.

A manufacturing method of a display panel according to another aspect of the present invention is a method for manufacturing a display panel that includes: a pair of substrates disposed to face each other with a discharge space interposed; a plurality of longitudinal partitions that partition the discharge space, the partitions being provided to at least one of the substrates substantially along a predetermined first direction; and a phosphor layer provided between the partitions that neighbor each other substantially along a longitudinal direction of the partitions, the method including: a partition forming step to form the partitions on the at least one of the substrates; a base layer forming step to form a base layer by moving a first nozzle along a direction intersecting the longitudinal direction of the partitions formed in the partition forming step and applying a base forming agent on the at least one of the substrates using the first nozzle, the first nozzle being adapted to apply the base forming agent; and a phosphor layer forming step to form the phosphor layer after the base layer forming step by moving a plurality of second nozzles along the longitudinal direction of the partitions and between the partitions that neighbor each other and applying a phosphor paste on the base layer, the second nozzle being adapted to apply the phosphor paste.

DETAILED DESCRIPTION OF PREFERRED EMBODIMENT(S)

A first embodiment of the present invention will be described below with reference to the attached drawings.

[Arrangement of Plasma Display Panel]

Figure 1:
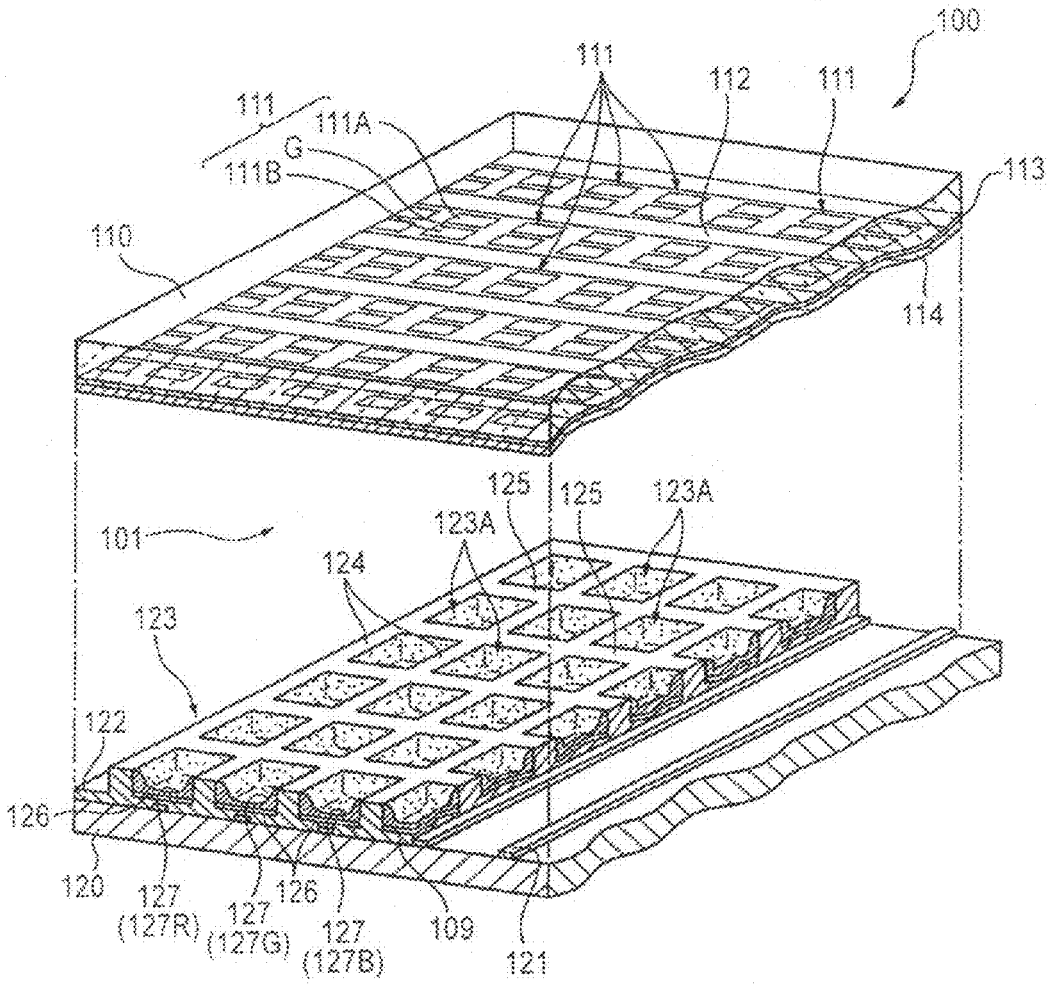
FIG. 1 is an exploded perspective view showing a plasma display panel according to an embodiment of the present invention.

FIG. 1 is a perspective view showing a substrate of a plasma display panel according to the first embodiment of the present invention.

In FIG. 1, the numeral 100 refers to a plasma display panel serving as a display panel, and the plasma display panel (PDP) 100 is shaped in a substantially rectangular plate.

As shown in FIG. 1, in the PDP 100, a front substrate 110 and a rear substrate 120 are disposed to face each other with a discharge space provided therebetween.

In an inner side of the front substrate 111, a plurality of display electrodes 111, a plurality of black stripes 112, a dielectric layer 113 and a protective layer 114 are provided.

Specifically, the display electrode 111 includes: plural pairs of transparent electrodes 111A, 111B that face each other with a discharge gap G therebetween; and a pair of linear bus electrodes (not shown) laminated on one ends of the transparent electrodes 111A, 111B. The transparent electrodes 111A, 111B are each a transparent conductive film that is formed of, for example, ITO (Indium Tin Oxide) or the like, and each pair of transparent electrodes 111A, 111B is provided to correspond to a discharge cell serving as a predetermined display cell.

The bus electrodes, which are linearly formed of, for example, Ag (silver) or the like, are laminated on the ends of the pair of transparent electrodes 111A, 111B, the ends being on sides opposite to the discharge gap G. One ends of the bus electrodes are provided with bus electrode leading portions (not shown), through which a voltage pulse from a row electrode driver (not shown) is applied to the transparent electrodes 111A, 111B.

The black stripe 112 is linearly formed of, for example, a black inorganic pigment or the like. The black stripe 112 absorbs visible light irradiated from the outside of the front substrate 110.

The dielectric layer 113, which is formed of, for example, a dielectric paste or the like, is arranged to face an address-electrode dielectric layer 122 of the rear substrate 120. When the panel is driven, the dielectric layer 113 prevents the display electrodes 12 from being damaged by the discharge panel and accumulates electric charges required for the drive.

The protective layer 114, which is a transparent layer that is formed of MgO (magnesium oxide) by vapor deposition, sputtering or the like, covers the entire inner surface of the dielectric layer 113. The protective layer 114 prevents the dielectric layer 113 from being sputtered due to the discharge while serving as a discharge layer of a secondary electron for generating the discharge at a low voltage.

The rear substrate 120, which is a rectangular glass plate, includes an address electrode 121, the address-electrode dielectric layer 122, a partition layer 123, a base layer 126, a phosphor layer 127 and the like.

The address electrode 121 is provided in plurality in parallel to, for example, a width direction of the rear substrate 120, thereby forming zonal patterns. The address electrode 121 is formed of, for example, a thin film of Aluminum (Al) by photolithography or the like. In addition, both ends of the address electrode 121 are provided with a leading electrode (not shown) for guiding a predetermined signal to the address electrode 121, the leading electrode being drawn outward from an end periphery of the address-electrode dielectric layer 122.

The address-electrode dielectric layer 122 is formed exemplarily of glass paste to protect the address electrode 121. The address-electrode dielectric layer 122 is provided on the inner side of the rear substrate 120 to cover the address electrode 121.

The partition layer 123 is formed exemplarily of the glass paste containing the same components as the glass paste forming the address-electrode dielectric layer 122 and provided on a surface facing the front substrate 110. As shown in FIG. 1, the partition layer 123 includes: a plurality of first partitions 124 provided substantially along the width direction (a first direction) of the PDP 100; and a plurality of second partitions 125 provided substantially along a column direction (a second direction), which is perpendicular to the width direction. A recessed portion 123A is defined by the first partitions 124 and the second partitions 125. Particularly, the recessed portion 123A is provided to a portion where the first groove defined by the neighboring first partitions 124 to be located therebetween is superposed on a second groove defined by the neighboring second partitions 125 to be located therebetween. A height dimension of the second partition 125 from a surface of the address-electrode dielectric layer 122 is smaller than that of the first partition 124.

As shown in FIG. 1, the base layer 126 is formed on the address-electrode dielectric layer 122 to stay within the recessed portions 123A of the partition layers 123.

The base layer 126 preferably has a reflection rate of 80 percent or more in a visible light region, and the base layer 126 is preferably chemically stable under a temperature of 200° C. or less. A particle size of a base-forming agent for forming the base layer 126 is preferably equal to or less than a particle size of a phosphor contained in a phosphor paste for forming the later-described phosphor layer 127. Specifically, as the base-forming agent for forming the base layer 126, powder of an oxide such as $SiO_2$, $TiO_2$, $ZrO_2$, $ZnO_2$ and the like is preferably used.

A thickness dimension of the base layer 126 is not specifically limited, but is preferably substantially equal to a thickness dimension of the later-described phosphor layer (i.e., a half of the summed thickness of the base layer 126 and the phosphor layer 127). Although the thicknesses of the base layer 126 and the phosphor layer 127 are generally limited by properties required in the PDP 100 such as a substrate reflection rate and a luminescence rate of the phosphor layer 127, a good substrate reflection rate and a good luminescence rate of the phosphor layer 127 can be realized by substantially equalizing the thicknesses of the base layer 126 and the phosphor layer 127 as described above.

The phosphor layer 127 is continuously provided in a first groove between the neighboring first partitions 124 to longitudinally extend along the longitudinal direction of the first partition 124 (the width direction of the PDP 100).

Specifically, the phosphor layer 127 includes a red phosphor layer 127R, a green phosphor layer 127G and a blue phosphor layer 127B. As shown in FIG. 1, each of the phosphor layers 127R, 127G, 127B are allayed in plurality in the longitudinal direction of the second partition 124 in the order of the red phosphor layer 127R, the green phosphor layer 127G and the blue phosphor layer 127B. The phosphor layers 127R, 127G, 127B are continuously provided along the first groove between the first partitions 124.

[Manufacturing Method of Plasma Display Panel]

Next, a manufacturing method of the above-described PDP 100 will be described.

Figure 2A:
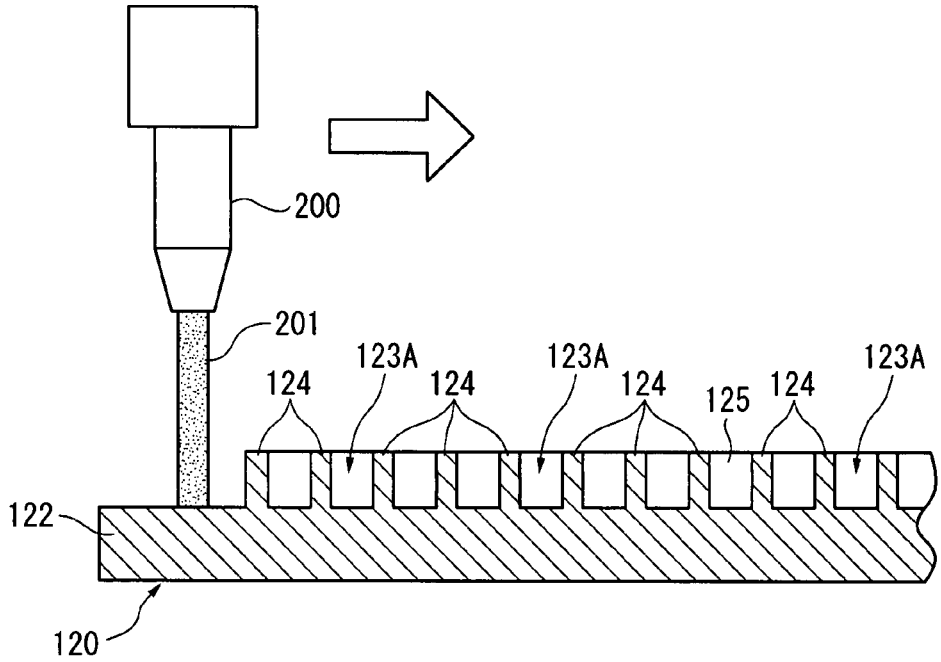
FIG. 2A is a side cross-sectional view showing a rear substrate in a base layer forming step according to the embodiment.
Figure 2B:
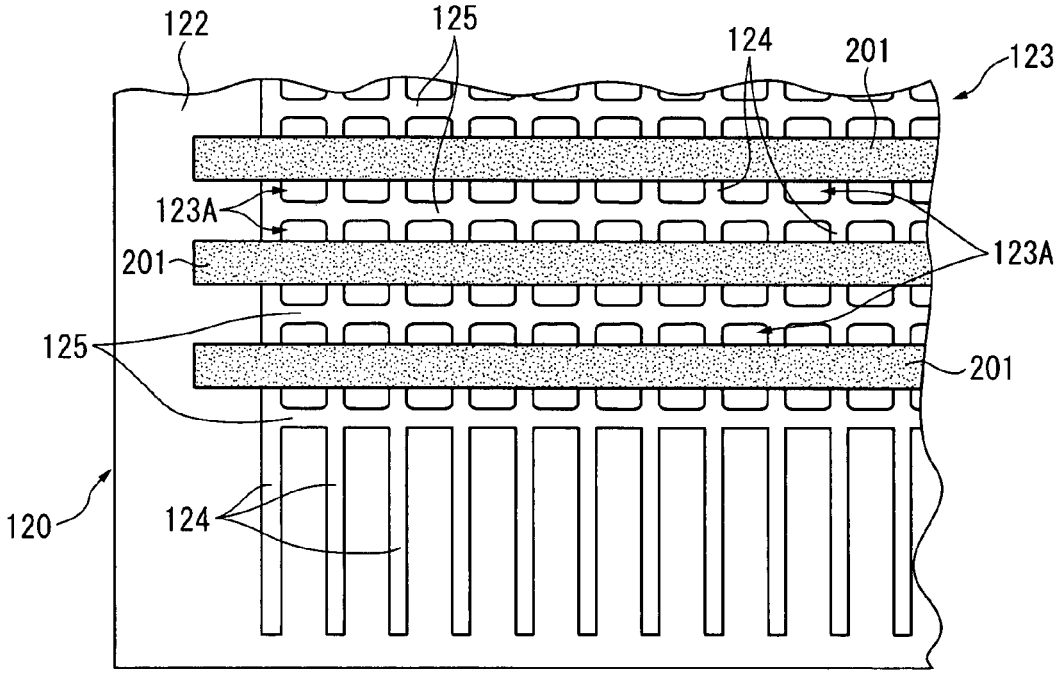
FIG. 2B is a plan view showing the rear substrate in the phosphor layer forming step according to the embodiment.
Figure 3A:
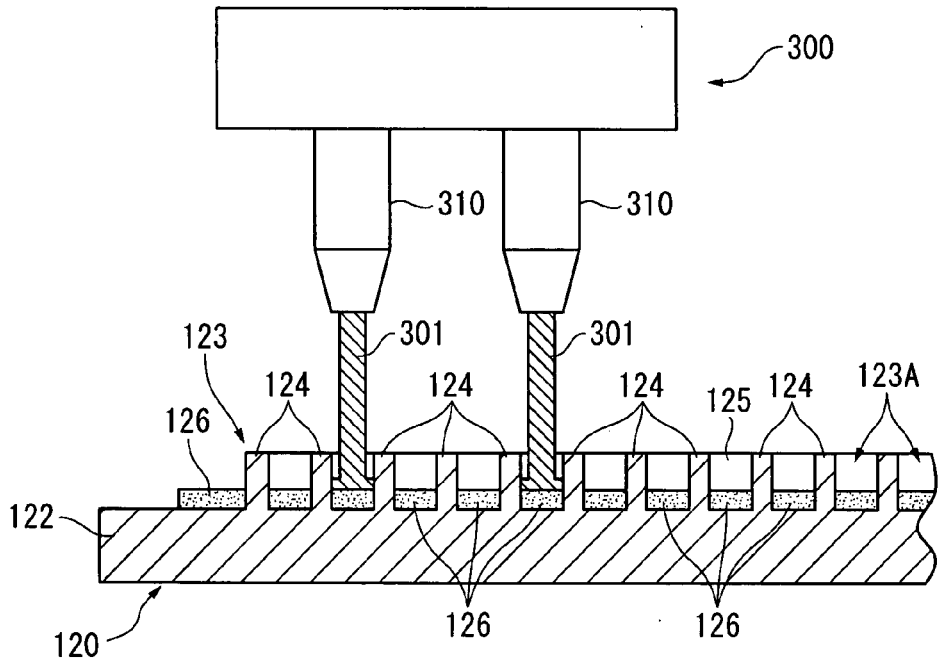
FIG. 3A is a side cross-sectional view showing the rear substrate in a phosphor layer forming step according to the embodiment.
Figure 3B:
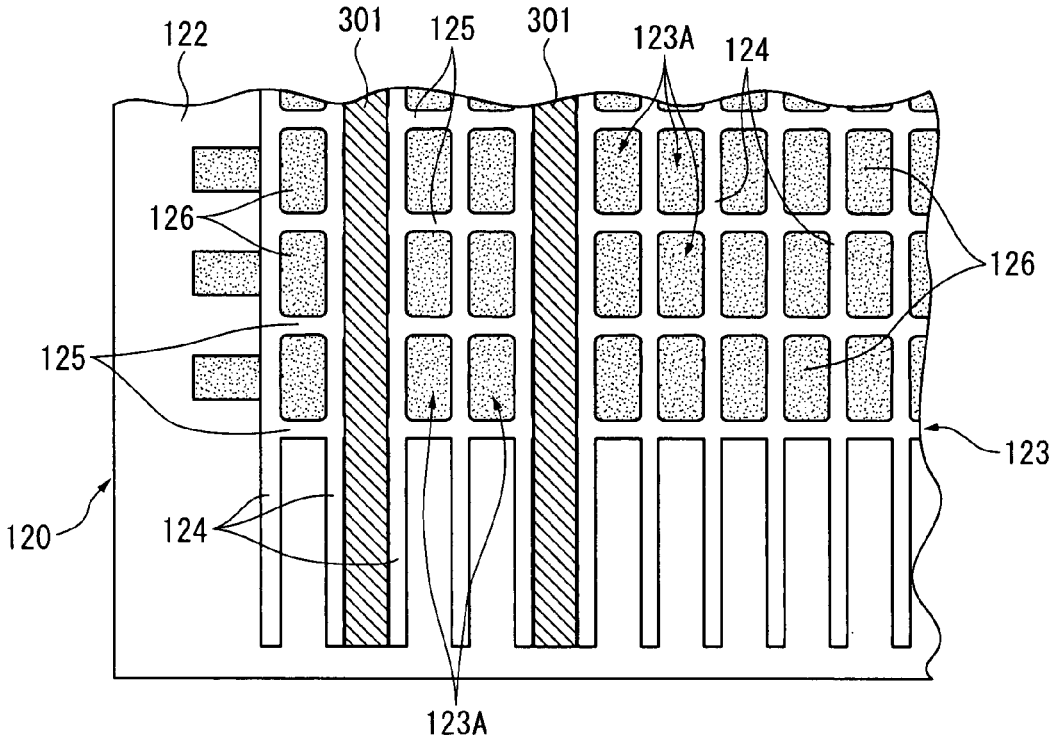
FIG. 3B is a plan view showing the rear substrate in the phosphor layer forming step according to the embodiment.

FIG. 2A is a side cross-sectional view showing the rear substrate in the base layer forming step while FIG. 2B is a plain view showing the rear substrate in the base layer forming step. FIG. 3A is a side cross-sectional view showing the rear substrate in the phosphor layer forming step while FIG. 3B is a plain view showing the rear substrate in the phosphor layer forming step.

The manufacturing method of the PDP 100 according to the present embodiment includes: a front substrate manufacturing step for manufacturing the front substrate 110; a rear substrate manufacturing step for manufacturing the rear substrate 120; and a superposing step for superposing the front substrate 110 and the rear substrate 120 to manufacture the PDP 100.

In the front substrate manufacturing step, a transparent-electrode-forming material layer is provided on the entirety of the inner side of the front substrate 110, and the transparent electrodes 111A, 111B are formed. Then, linear patterns formed of Ag material are laminated on ends of the transparent electrodes 111A, 111B, and the bus electrodes is formed by calcination of the patterns. Subsequently, a paste pattern of a black inorganic pigment is exemplarily applied between the bus electrodes, whereby the plurality of black stripes 112 are formed by calcination of the paste pattern. Then, a dielectric paste is applied to the front substrate 110 in laminae, whereby the dielectric layer 113 is formed by calcination of the dielectric paste. The protective layer 134 is film-formed on the dielectric layer 113 by vapor deposition, sputtering or the like.

Next, the rear substrate manufacturing step is performed. The rear substrate manufacturing step includes an address electrode forming step, a dielectric layer forming step, a partition forming step, the base layer forming step and the phosphor layer forming step.

In the address electrode forming step, the address electrode 121 is formed on the rear substrate 120. In the dielectric layer forming step, the address-electrode dielectric layer 122 is formed to cover the address electrode 121.

In the partition forming step, a partition-forming material layer is uniformly applied to the address-electrode dielectric layer 122. Then, a film molding die is exemplarily disposed on the partition-forming material layer, and the partition layer 123 is formed by plastic-deforming the partition-forming material layer using a transfer roller. The molding die has convexes and concaves of predetermined dimensions that correspond to the first partition 124, the second partition 125 and the recessed portion 123A. By plastic-deforming the partition-forming material layer by the transfer roller, there is provided the partition layer 123 including: the first partition 124 extending in the width direction; the second partition 125 extending in the column direction; and the partition end layer 123 having the recessed portion 123A defined by the first partition 124 and the second partition 125, as described above.

In the base layer forming step, the base-forming agent in paste form is applied on the partition layer 123 of the rear substrate 120 using a base-forming-agent applying nozzle 200 (a first nozzle) shown in FIGS. 2A and 2B to form the base layer 126 thereon. The nozzle 200 is adapted to be moved by a base-nozzle scanning mechanism (not shown) in the longitudinal direction of the second partition 125, i.e., the column direction of the PDP 100. Although the nozzle 200 is singularly provided in an arrangement shown in FIGS. 2A and 2B, the plurality of nozzles 200 are provided to be movable by the base-nozzle scanning mechanism in an actual arrangement (i.e., a multi-nozzle method), so that the base-forming agent can be simultaneously applied to a plurality of lines.

Specifically, as shown in FIG. 2A, the nozzle 200 is positioned at a first end of the second groove formed between the second partitions 125 (a first end of the PDP 100 in the column direction) in an initial state of the base layer forming step. Then, the nozzle 200 is moved from the position of the initial state to a second end of the second groove along the longitudinal direction of the second partition 125 at a predetermined constant speed, passing above the second groove. At this time, as shown in FIG. 2B, the nozzle 200 ejects and applies the base-forming agent 201 along the second groove between the second partitions 125. The applied base-forming agent 201, which is pasty as described above, spreads within the recessed portion 123A with a uniform thickness dimension maintained.

With respect to the base-forming agent 201 ejected from the nozzle 200, an amount of the base-forming agent 201 ejected by the nozzle 200 and a movement speed of the nozzle 200 are set such that the thickness of the to-be-formed base layer 126 is substantially equalized to the thickness of the phosphor layer 127 (12.5 μm in the present embodiment).

Then, after the base-forming agent is filled in the recessed portions 123A, the base layer 126 is calcinated by heat treatment.

In the phosphor layer forming step, the phosphor layer 127 is formed by applying the phosphor paste. In applying the phosphor paste, a phosphor applying device 300 adapted to inject the phosphor paste is used as shown in FIGS. 3A and 3B. The phosphor applying device 300 is adapted to be moved by a phosphor-nozzle scanning mechanism (not shown) in the longitudinal direction of the first partition 124, i.e., the width direction of the PDP 100. The phosphor applying device 300 includes a plurality of phosphor applying nozzles 310 (second nozzles).

The phosphor applying nozzles 310 are positioned at a first end of the first groove between the first partitions 124 when the phosphor applying is started. Then, the nozzle 310 is moved from the position of the initial state to a second end of the first groove along the longitudinal direction of the first partition 124 at a predetermined constant speed, passing above the first groove. At this time, as shown in FIG. 3B, the nozzle 310 ejects to apply the phosphor paste 301 along the first groove between the first partitions 124. As shown in FIG. 1, the phosphor applying device 300 applies phosphor pastes of different colors to the neighboring first grooves. For instance, the phosphor applying device 300 applies the phosphor pastes such that a red phosphor paste for forming a red phosphor layer 127R, a green phosphor paste for forming a green phosphor layer 127G and a blue phosphor paste for forming a blue phosphor layer 127B are applied to be aligned in the neighboring first grooves in this order.

Thereafter, a heat-treating step for heat-treating the applied phosphor paste 301 is performed, such that the phosphor layer 127 is formed by calcination.

Subsequently, by performing the superposing step, the front substrate 110 and the rear substrate 120 are superposed to manufacture the PDP 100.

[Effects and Advantages of Plasma Display Panel]

According to the above-described arrangement according to the present embodiment, the following effects and advantages are expected.

(1) In the manufacturing method of the PDP 100 according to the present embodiment, the first partition 124 and the second partition 125 substantially perpendicular to the first partition 124 are formed on the address-electrode dielectric layer 122 of the rear substrate 120 in the partition forming step, such that the recessed portion 123A corresponding to the display cell is formed. After the partition forming step, the nozzle 200 is moved along the second groove formed between the second partitions 125 to form the base layer 126 by applying the base-forming agent 201 in the base layer forming step. After the base layer forming step, the phosphor applying nozzle 310 is moved along the first groove formed between the first partitions 124 to form the phosphor layer 127 by applying the phosphor agent 301 in the phosphor layer forming step.

With this arrangement, since the base-forming agent is applied in a direction substantially perpendicular to a direction in which the phosphor paste 301 is applied, the thickness of the base layer 126 formed in a first recessed portion 123A is substantially equalized to the thickness of the base layer 126 formed in a second recessed portion 123A that neighbors the first recessed portion 123A along the first groove. Accordingly, when the phosphor paste 301 is applied on the base-forming agent in the phosphor layer forming step, the difference in the summed thickness of the base layer 126 and the phosphor layer 127 between the neighboring first grooves is reduced, whereby a column variation and a luminance variation between the phosphor layers 127 on the neighboring first grooves can be favorably prevented. In addition, since the phosphor layer 127 is formed on the surface of the base layer 126, the thickness of the phosphor layer 127 can be reduced as compared to an arrangement in which the phosphor layer 126 is formed without forming the base layer 126. Accordingly, even when, for example, a manufacturing error is caused in a diameter dimension of an opening of the phosphor applying nozzle 310, the difference in the thickness of the phosphor layer 127 due to the error in the diameter dimension of the opening is not increased, thereby preventing the column variation and the luminance variation.

In the base layer forming step and the phosphor layer forming step, the base-forming-agent applying nozzle 200 and the phosphor applying nozzle 310 are used to apply the base-forming agent 201 and the phosphor paste 301. When the base-forming agent 201 and the phosphor paste 301 are applied using the nozzles, a variability of the applied agent and paste in advancing directions of the nozzles (applying directions) is generally reduced. Thus, by applying the base-forming agent 201 and the phosphor paste 301 using the nozzles as in the present embodiment, the variability of the applied agent and paste in the applying directions can be prevented, thereby favorably preventing the column variation and the luminance variation.

As described above, since the quality of the manufactured PDP 100 can be maintained at a constant level by preventing the column variation and the luminance variation, a quality control can be facilitated.

In addition, by simply moving the nozzle 200 along the longitudinal direction of the second partition 125 such that the base-forming agent 201 is ejected, the base-forming agent 201 can be easily applied. Likewise, by simply moving the phosphor applying device 300 along the longitudinal direction of the first partition 124 such that the phosphor applying nozzle 310 ejects the phosphor paste 301, the phosphor paste 301 can be easily applied. Accordingly, a manufacturing process and a quality control for the PDP 100 can be facilitated.

(2) The base layer 126 is formed on the partition layer 123 of the rear substrate 120 using the plurality of the base-forming-agent applying nozzles 200 in the base layer forming step.

With this arrangement, the base-forming agent can be simultaneously applied along the plurality of second grooves, whereby rapid operations in the base layer forming step can be realized. Even when there is a manufacturing error in the diameter dimensions of the openings of the plural nozzles 200, the same amount of the base-forming agent 201 can be applied to the recessed portions 123A neighboring each other along the first groove, whereby the thicknesses of the phosphor layers 127 in the neighboring first grooves can be uniformed. Thus, even when the base-forming agent is simultaneously applied along the plurality of second grooves using the plurality of nozzles 200, the column variation and the luminance variation of the PDP 100 can be prevented.

(3) The phosphor pastes of different colors are applied in the neighboring first grooves in the phosphor layer forming step. For example, the phosphor pastes 301 are applied, for example, in the order of the red phosphor paste, the green phosphor paste and the blue phosphor paste.

Accordingly, by conducting discharge in a predetermined display cell in the discharge space of the PDP 100, the display cell can emit light of a color corresponding to the cell.

Other Embodiments

It should be noted that the present invention is not limited to the embodiments described above but includes modifications, improvements and the like within a scope where an object of the present invention can be achieved.

For instance, although the curb-shaped partition is formed on the rear substrate 120 by the mutually-perpendicular first and second partitions 124, 125 in the above embodiment, the arrangement is not limited thereto. For example, the partition layer 123 may be provided in a striped shape by substantially parallel-aligning the plurality of first partition 124. In this case, as in the above embodiment, the column variation and the luminance variation of the PDP 100 can be prevented by moving the nozzle 200 in a direction substantially perpendicular to the first partition 124 to apply the base-forming agent 201 in the base layer forming step.

The applying direction of the base-forming agent 201 is not limited to the direction substantially perpendicular to the first partition 124. For example, by parallel-moving the applying direction of the plural nozzles 200 in a direction in which the applying direction intersects with the first partitions 124, the base-forming agent 201 may be applied.

EXAMPLES

Next, the PDP 100 manufactured by the above-described manufacturing method will be described in detail.

Example 1

By the manufacturing method of the PDP 100 according to the above embodiment, the base layer 126 was formed, and the phosphor layer 127 was formed on the surface of the base layer 126. As the base-forming agent for forming the base layer 126, titania ($TiO_2$) was used. The summed thickness of the base layer 126 and the phosphor 127 was 25 μm while the thicknesses of the base layer 126 and the phosphor layer 127 were respectively 12.5 μm.

Comparative Example 1

In the manufacturing method of the PDP 100, the phosphor layer forming step was performed after the partition forming step without performing the base layer forming step. In the phosphor layer forming step, the phosphor pastes was applied in two reciprocations in the same first groove, such that the phosphor layer of 25 μm thickness was formed.

Comparative Example 2

In the base layer forming step in the manufacturing method of the PDP 100, the base-forming agent was applied along the second groove by printing to form the base layer. As the base-forming agent for forming the base layer 126, titania ($TiO_2$) was used. The summed thickness of the base layer 126 and the phosphor 127 was 25 μm while the thicknesses of the base layer 126 and the phosphor layer 127 were respectively 12.5 μm.

Comparative Example 3

In the base layer forming step in the manufacturing method of the PDP 100, the nozzle 200 was moved along the first groove to apply the base-forming agent 201, thereby forming the base layer 126. As the base-forming agent for forming the base layer 126, titania ($TiO_2$) was used. The summed thickness of the base layer 126 and the phosphor 127 was 25 μm while the thicknesses of the base layer 126 and the phosphor layer 127 were respectively 12.5 μm.

[Evaluation Method]

Respective values of in-plane variations 3σ of the PDP 100 manufactured in Example 1 described above and the PDPs 100 manufactured in Comparative Examples 1 to 3 were measured. The measurement results are shown in Table 1.

TABLE 1

| | Applying Method | Thickness | | | |
|---|---|---|---|---|---|
| | | Average Thickness (μm) | Phosphor Layer Thickness (μm) | Base Layer Thickness (μm) | In-Plane Average Variation 3σ (μm) |
| Example 1 | Perpendicularly Applying Phosphor and Base-Forming Agent (Nozzle) | 25 | 12.5 | 12.5 | 2.3 |
| Comparative Example 1 | Phosphor | 25 | 25 | 25 | 3.9 |
| Comparative Example 2 | Print-Applying Phosphor and Base-Forming Agent | 25 | 12.5 | 12.5 | 2.8 |
| Comparative Example 3 | Applying Phosphor and Base-Forming Agent in the Same Direction (Nozzle) | 25 | 12.5 | 12.5 | 3.6 |

As shown in Table 1, in Comparative Examples 1 and 3, the in-plane average variations 3σ of the thicknesses of the base layer 126 and the phosphor layer 127 were respectively 3.9 μm and 3.6 μm, whereby a column variation and a luminance variation were observed. In Comparative Example 2, the in-plane average variation 3σ of the thicknesses of the base layer 126 and the phosphor layer 127 was 2.8 μm, whereby a luminance variation was observed although no column variation was observed. In contrast, in Example 1 described above, the in-plane average variation of the phosphor layer 127 and the base layer 126 was 2.3 μm, whereby neither a column variation nor a luminance variation was observed, and good images were realized.

Effects and Advantages of Embodiments

As described above, in the manufacturing method of the PDP 100 according to the present embodiment, the first partition 124 and the second partition 125 substantially perpendicular to the first partition 124 are formed on the address-electrode dielectric layer 122 of the rear substrate 120 in the partition forming step, such that the recessed portion 123A corresponding to the display cell is formed. After the partition forming step, the nozzle 200 is moved along the second groove formed between the second partitions 125 to form the base layer 126 by applying the base-forming agent 201 in the base layer forming step. After the base layer forming step, the phosphor applying nozzle 310 is moved along the first groove formed between the first partitions 124 to form the phosphor layer 127 by applying the phosphor agent 301 in the phosphor layer forming step.

With this arrangement, since the base-forming agent is applied with the nozzle 200 in a direction substantially perpendicular to the applying direction of the phosphor paste 301, the difference in the summed thickness of the base layer 126 and the phosphor layer 127 between the neighboring first grooves can be reduced. In addition, since the variation in the applying direction can be reduced due to the nozzle, the in-plane variation of the summed thickness of the base layer 126 and the phosphor layer 127 can be further reduced. Accordingly, the column variation and the luminance variation between the phosphor layers 127 of the neighboring first grooves can be favorably prevented. In addition, by applying the base-forming agent 201 along the second groove using the nozzle 200, the base layer 126 can be easily formed.

The priority application Number JP2006-341605 upon which this patent application is based is hereby incorporated by reference.

What is claimed is:

1. A manufacturing method of a display panel, the display panel including: a pair of substrates disposed to face each other with a discharge space interposed; a plurality of longitudinal partitions that partition the discharge space, the partitions being provided to at least one of the substrates substantially along a predetermined first direction; and a phosphor layer provided between the partitions that neighbor each other substantially along a longitudinal direction of the partitions, the method comprising:

a partition forming step to form the partitions on the at least one of the substrates;

a base layer forming step to form a base layer by moving a first nozzle along a direction intersecting the longitudinal direction of the partitions formed in the partition forming step and applying a base forming agent on the at least one of the substrates using the first nozzle, the first nozzle being adapted to apply the base forming agent; and a phosphor layer forming step to form the phosphor layer after the base layer forming step by moving a plurality of second nozzles along the longitudinal direction of the partitions and between the partitions that neighbor each other and applying a phosphor paste on the base layer, the second nozzle being adapted to apply the phosphor paste.

2. The manufacturing method according to claim 1, wherein in the base layer forming step, a plurality of first nozzles are used, and the base forming agent is applied to the at least one of the substrates using the plurality of first nozzles.

3. The manufacturing method according to claim 1, wherein in the partition forming step, a plurality of first partitions and a plurality of second partitions are formed such that a display cell defined by the first partitions and the second partitions is formed, the first partitions being substantially parallel to the first direction, the second partitions being substantially parallel to a second direction substantially perpendicular to the first direction.

4. The manufacturing method according to claim 3, wherein in the phosphor layer forming step, plural phosphor pastes of different colors are continuously applied to respectively different portions between the first partitions along the first direction.

5. The manufacturing method according to claim 3, wherein in the base layer forming step, the base forming agent is continuously applied between the second partitions along the second direction.

* * * * *